US008596460B2

(12) United States Patent
Scatterday

(10) Patent No.: US 8,596,460 B2
(45) Date of Patent: Dec. 3, 2013

(54) COMBINATION BOX AND DISPLAY UNIT

(71) Applicant: NJOY, Inc., Scottsdale, AZ (US)

(72) Inventor: Mark Scatterday, Scottsdale, AZ (US)

(73) Assignee: NJOY, Inc., Scottsdale, AZ (US)

( * ) Notice: Subject to any disclaimer, the term of this patent is extended or adjusted under 35 U.S.C. 154(b) by 0 days.

(21) Appl. No.: 13/707,378

(22) Filed: Dec. 6, 2012

(65) Prior Publication Data

US 2013/0277270 A1 Oct. 24, 2013

Related U.S. Application Data

(60) Provisional application No. 61/614,973, filed on Mar. 23, 2012, provisional application No. 61/674,725, filed on Jul. 23, 2012.

(51) Int. Cl.
*B65D 5/50* (2006.01)
*B65D 5/52* (2006.01)

(52) U.S. Cl.
USPC ..... 206/736; 206/746; 206/750; 229/164

(58) Field of Classification Search
USPC ..... 206/736, 746, 750; 229/102.5, 117.23, 229/117.24, 171, 177, 195, 164
See application file for complete search history.

(56) References Cited

U.S. PATENT DOCUMENTS

| | | | | |
|---|---|---|---|---|
| 2,502,561 | A * | 4/1950 | Ebert | 206/750 |
| 3,146,937 | A * | 9/1964 | Vesak | 229/117.22 |
| 3,567,014 | A * | 3/1971 | Feigelman | 206/767 |
| 5,881,884 | A | 3/1999 | Podosek | |
| 6,431,363 | B1 | 8/2002 | Hacker | |
| 7,988,034 | B2 * | 8/2011 | Pezzoli | 229/235 |
| 8,302,845 | B2 * | 11/2012 | Bell et al. | 229/103 |
| 8,342,335 | B2 * | 1/2013 | Couture | 206/746 |
| 2001/0052480 | A1 * | 12/2001 | Kawaguchi et al. | 206/736 |
| 2002/0043554 | A1 * | 4/2002 | White et al. | 229/235 |
| 2004/0149624 | A1 * | 8/2004 | Wischusen et al. | 206/736 |
| 2005/0145533 | A1 * | 7/2005 | Seligson | 206/575 |
| 2006/0054676 | A1 | 3/2006 | Wischusen, III | |
| 2006/0255105 | A1 * | 11/2006 | Sweet | 229/101.2 |
| 2010/0000672 | A1 | 1/2010 | Fogle | |
| 2010/0276333 | A1 | 11/2010 | Couture | |
| 2011/0049226 | A1 * | 3/2011 | Moreau et al. | 229/112 |

FOREIGN PATENT DOCUMENTS

WO WO2012021972 2/2012

* cited by examiner

*Primary Examiner* — Luan K Bui
*Assistant Examiner* — Rafael Ortiz
(74) *Attorney, Agent, or Firm* — Bookoff McAndrews, PLLC

(57) ABSTRACT

The present disclosure generally relates to a combination box and display unit. The unit may be used initially as a box to ship products, such as electronic cigarettes, and may then be converted into a display for the electronic cigarettes.

2 Claims, 5 Drawing Sheets

COMBINATION BOX AND DISPLAY UNIT

CROSS-REFERENCE TO RELATED APPLICATION

This disclosure claims priority to U.S. Provisional Application Ser. No. 61/614,973, titled ELECTRONIC CIGARETTE ATTACHMENTS, COMPONENTS AND HOLDERS to Craig Weiss and Mark Scatterday that was filed on Mar. 23, 2012 and to U.S. Provisional Application Ser. No. 61/674,725 titled COMBINATION BOX AND DISPLAY UNIT to Mark Scatterday that was filed on Jul. 23, 2012.

TECHNICAL FIELD

This disclosure generally relates to product packaging, and more particularly, to a combination box and display unit.

SUMMARY

This summary is provided to introduce a selection of concepts in a simplified form that are further described below in the DESCRIPTION OF THE DISCLOSURE. This summary is not intended to identify key features of the claimed subject matter, nor is it intended to be used as an aid in determining the scope of the claimed subject matter.

In accordance with aspects of the present disclosure, a configuration of product packaging for electronic cigarettes is presented. The disclosure presents a combination box and display unit for electronic cigarettes.

In accordance with one embodiment of the present invention, a combination box and display unit is disclosed. The combination box and display unit comprises: two side walls, each having a top portion and a bottom portion; a front wall having a top portion and a bottom portion; a back wall having a top portion and a bottom portion; a top; a bottom; and a tear strip extending through a middle portion of each of the front wall, the two side walls, and the back wall; wherein the tear strip is disengaged from each of the front wall, the two side walls, and the back wall in order to separate the top portions of the front wall, the two side walls, and the back wall from the bottom portions of the front wall, the two side walls, and the back wall.

In accordance with another embodiment of the present invention, a combination box and display unit is disclosed. The combination box and display unit comprises: two side walls, each having a top portion and a bottom portion; a front wall having a top portion and a bottom portion; a back wall having a top portion and a bottom portion; a top; a bottom; and a tear strip comprising two parallel perforated lines extending horizontally through a middle portion of each of the front wall and the back wall, and slanting upwardly and rearwardly through each of the two side walls; wherein the tear strip is disengaged from each of the front wall, the two side walls, and the back wall in order to separate the top portions of the front wall, the two side walls, and the back wall from the bottom portions of the front wall, the two side walls, and the back wall.

In accordance with another embodiment of the present invention, a combination box and display unit is disclosed. The combination box and display unit comprises: two side walls, each having a top portion and a bottom portion; a front wall having a top portion and a bottom portion; a back wall having a top portion and a bottom portion; a top; a bottom; four vertical edges defined by the front wall, the two side walls, and the back wall; a tear strip comprising two parallel perforated lines extending horizontally through a middle portion of each of the front wall and the back wall, and slanting upwardly and rearwardly through each of the two side walls; wherein the tear strip is disengaged from each of the front wall, the two side walls, and the back wall in order to separate the top portions of the front wall, the two side walls, and the back wall from the bottom portions of the front wall, the two side walls, and the back wall; and wherein the perforated lines comprise large slits that traverse each of the four vertical edges.

BRIEF DESCRIPTION OF DRAWINGS

The novel features believed to be characteristic of the application are set forth in the appended claims. In the descriptions that follow, like parts are marked throughout the specification and drawings with the same numerals, respectively. The drawing figures are not necessarily drawn to scale and certain figures can be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein:

DESCRIPTION OF THE DISCLOSURE

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

The present disclosure generally relates to product packaging which may be used for a variety of products, including electronic cigarettes. A combination box and display unit for carrying multiple electronic cigarettes will be described within the present disclosure. A number of advantages can be provided by the combination box and display unit described herein. For example, the box used for shipping the multiple electronic cigarettes can be converted to selling display units once opened, which helps to minimize waste. A number of additional advantages will become apparent from the description provided below.

FIGS. 1 through 8 will show the combination box and display unit 100. While the embodiments are described for use with electronic cigarettes, it should be clearly understood that the combination box and display unit 100 may be used with virtually any other type of product.

Figure 1:
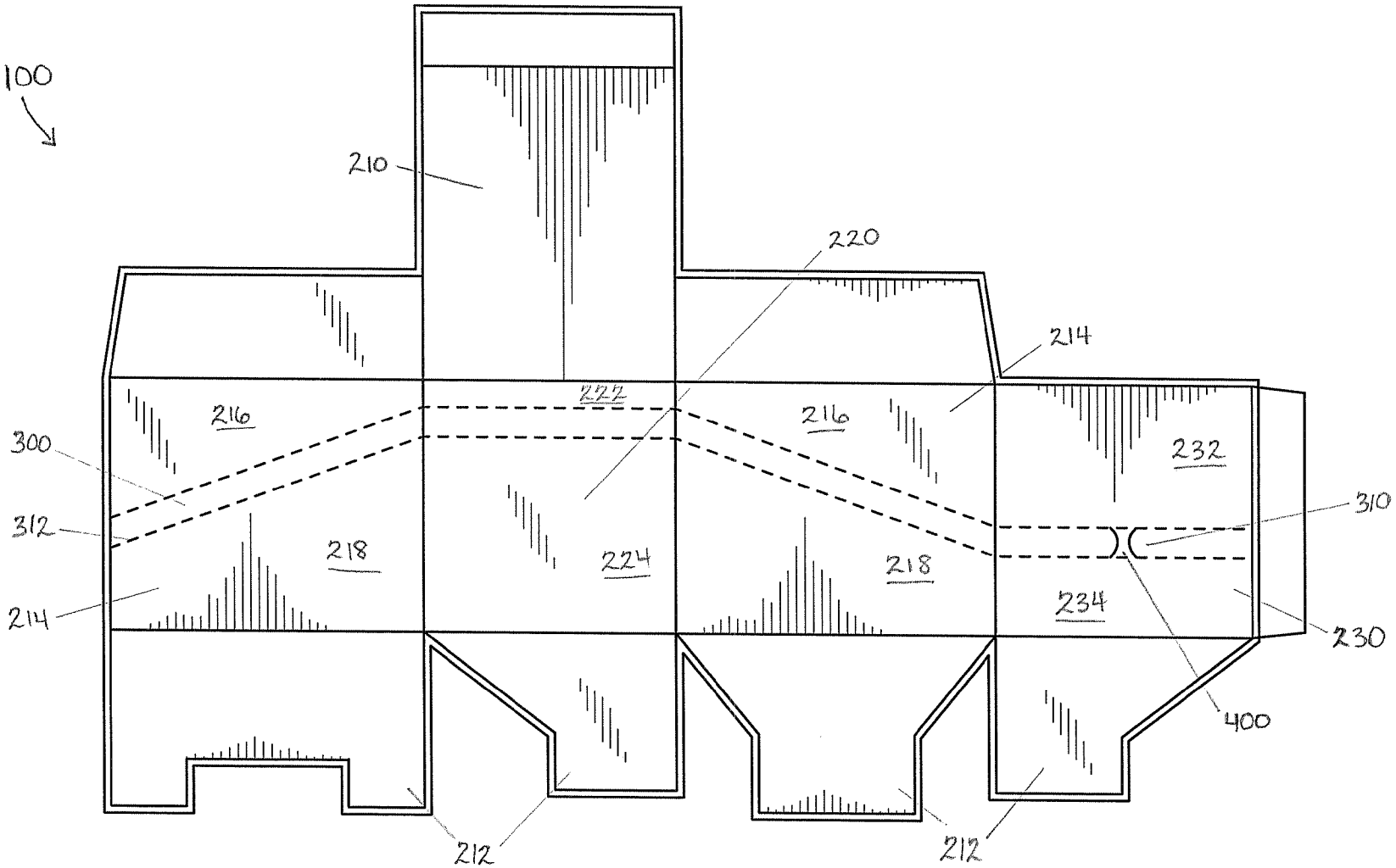
FIG. 1 is a top view of a flattened and unassembled combination box and display unit in accordance with an embodiment of the present invention.
Figure 2:
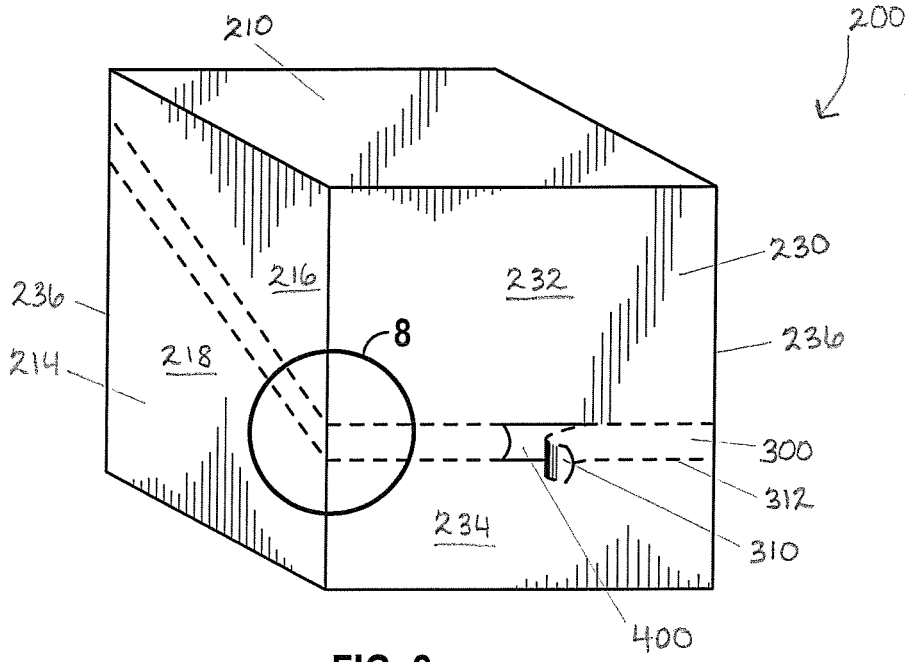
FIG. 2 is a perspective view of the combination box and display unit of FIG. 1, shown folded into a box formation.

Turning now to FIG. 1, a top view of a flattened and unassembled combination box and display unit 100 is shown. The unit 100 may be made of cardboard or any other suitable material and may comprise a main body having perforations 312 for disassembly, a blister tray 700, a header card 500, and a slot 228 for holding the header card 500. When the unit 100 is folded along the appropriate areas, the unit 100 forms a box 200, as shown in FIG. 2. The box 200 will have a left side wall 214, a right side wall 214, a front wall 230, a back wall 220, a bottom 212, and a top 210.

Referring to FIG. 1, the unit 100 may have two parallel, perforated lines 312 that together form a tear strip 300. When the unit 100 is in a flattened position, the tear strip 300 extends from the right side wall 214, through the back wall 220, through the left side wall 214, and through the front wall 230. The perforations 312 are shown to be slanted upwardly and rearwardly along the right side wall 214 and left side wall 214 and extends horizontally along the back wall 220 (see FIG. 5) and along the front wall 230 of the unit 100. It should be clearly understood that substantial benefit may be derived from the perforations 312 extending horizontally throughout the right side wall 214, back wall 220, left side wall 214, and front wall 230 of the unit 100.

Referring to FIG. 2, when the unit 100 is in the configuration of a box 200, the tear strip 300 has two ends 310 that come together at a notch 400. Although the notch 400 is shown to be positioned at the front of the box 200, it should be clearly understood substantial benefit may still be derived from the notch 400 being positioned at the right side wall 214, left side wall 214 or back wall 220 of the box 200.

Figure 3:
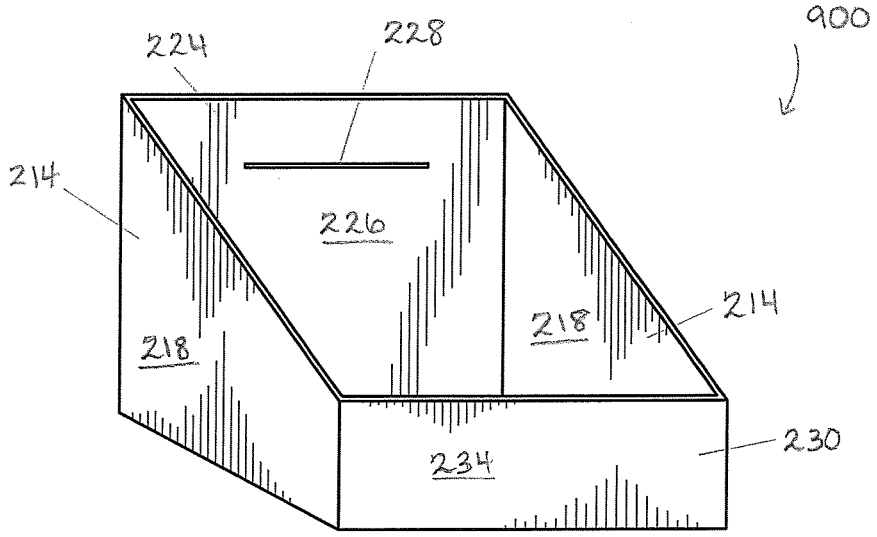
FIG. 3 is a perspective view of the combination box and display unit of FIG. 1, shown in a display unit formation with the tear strip removed and with top portions of the front wall, the side walls, and back wall disengaged from bottom portions of the front wall, the side walls, and the back wall.

As shown in FIG. 3, in order to convert the box 200 into a display 900, one may dislodge the notch 400 from the box 200, therefore creating a hole in the box 200. One may then take hold of one end 310 of the tear strip 300 and pull the tear strip 300 until the entire tear strip 300 is dislodged from the box 200. Once the tear strip 300 is removed, then the entire top 210 of the box 200 along with a top portion 216 of the left side wall 214, a top portion 222 of the back wall 220, a top portion 232 of the front wall 230, and a top portion 216 of the right side wall 214 of the box 200 will also be dislodged from a bottom portion 218 of the left side wall 214, a bottom portion 224 of the back wall 220, a bottom portion 234 of the front wall 230, and a bottom portion 218 of the right side wall 214 of the box 200, respectively. The remaining bottom 212 of the box 200, the bottom portion 218 of the left side wall 214, the bottom portion 224 of the back wall 220, the bottom portion 234 of the front wall 230, and the bottom portion 218 of the right side wall 214 of the box 200 together form the display 900. If the tear strip 300 is torn along perforations 312 that are in a slanted configuration, as shown in FIG. 2, then the right side of the display 900 and the left side of the display 900 will slant upwardly toward the back of the display 900 and the back of the display 900 will be taller than the front of the display 900.

In another embodiment, the two ends 310 of the tear strip 300 may come together without the formation of a notch 400. Because of the perforations 312, a user may simply apply pressure to one end 310 or both ends 310 in order to dislodge the end(s) 310 and begin tearing the tear strip 300.

Figure 4:
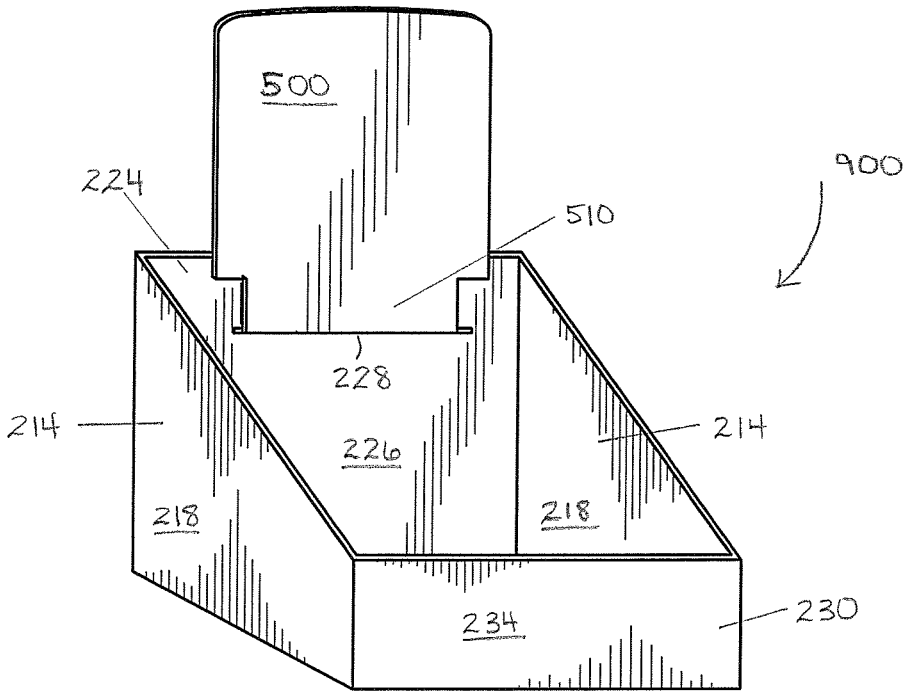
FIG. 4 is a perspective view of the combination box and display unit of FIG. 3 shown with a header card inserted into a slot in the interior surface of the back wall.
Figure 5:
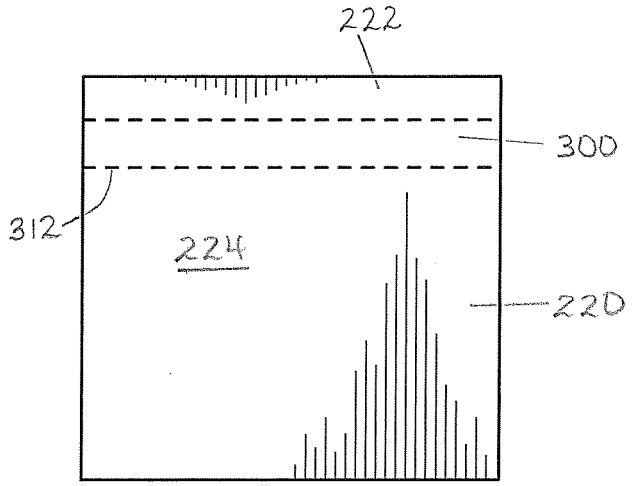
FIG. 5 is a rear view of the combination box and display unit of FIG. 2.

FIG. 4 is a top view of a header card 500 that may be used with the display 900. Product advertising may be printed upon the header card 500. An interior surface 226 of the back wall 220 of the display 900 may have a slot 228 for receiving a bottom portion 510 of the header card 500 so that customers may see the header card 500 from a distance. The slot 228 may be made of molded plastic, polystyrene, paper or other suitable material. It should be clearly understood that substantial benefit may be derived from the slot 228 being a separate component that is then adhered to the interior surface 226 of the back wall 220 of the display 900.

Figure 6:
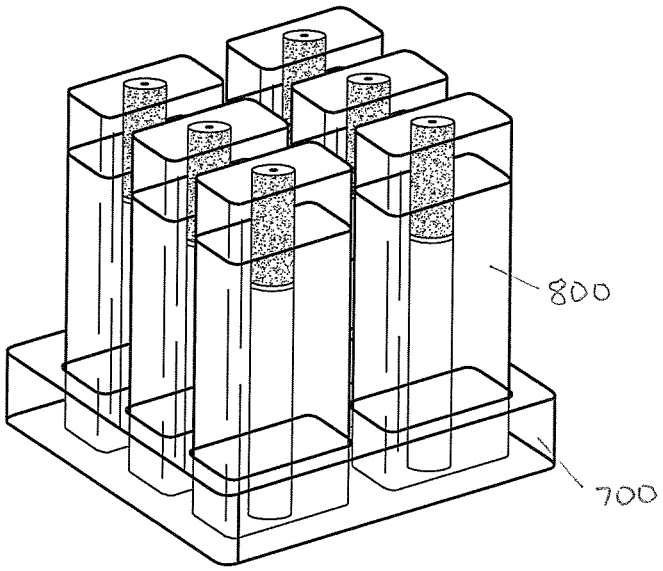
FIG. 6 is a perspective view of a blister tray of the combination box and display unit of the present invention.
Figure 7:
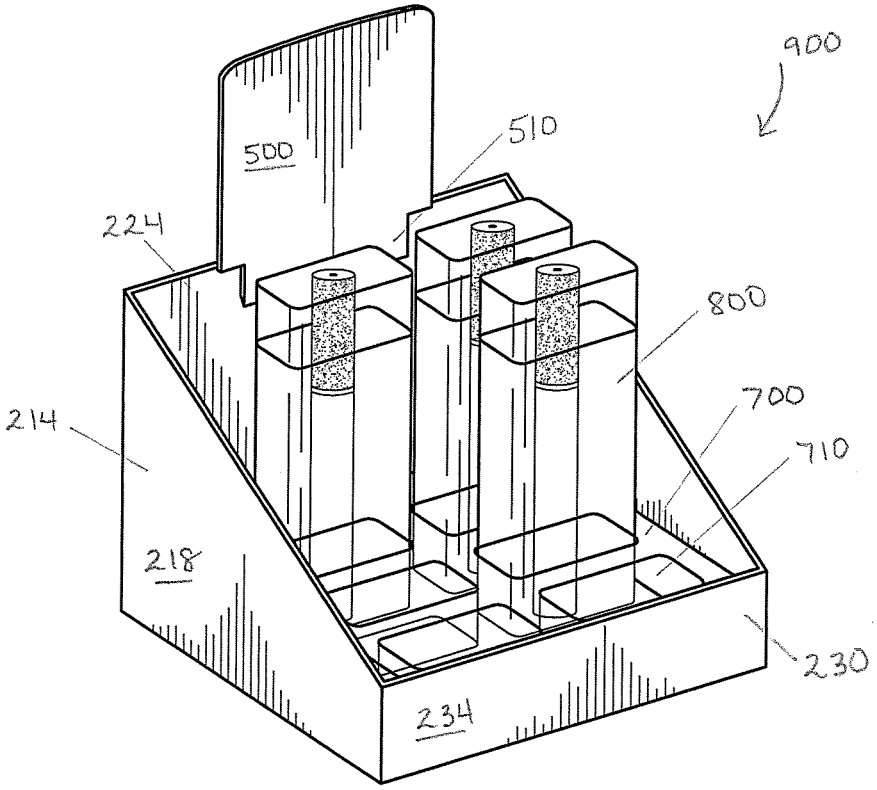
FIG. 7 is a perspective view of the combination box and display unit of the present invention with the blister tray shown holding product and with the header card shown inserted into the slot on the interior surface of the back wall.

FIGS. 6 and 7 show a blister tray 700 that may be included with the unit 100. The blister tray 700 may be formed of molded plastic, polystyrene, or other suitable material. The blister tray 700 may have a plurality of indentations 710 shaped to receive at least one of the products 800 (e.g. electronic cigarettes) being shipped within the unit 100. The blister tray 700 may be removable from the bottom 212 of the box 200/display 900 or it may be firmly attached to the bottom 212 of the box 200/display 900 by any suitable adhesive.

Figure 8:
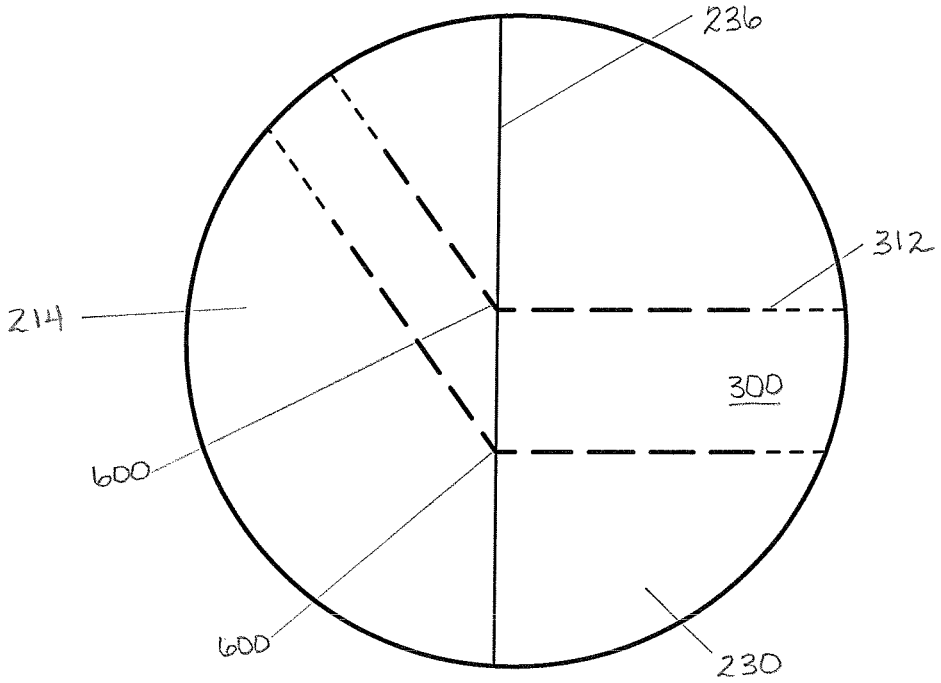
FIG. 8 is an enlarged view of a vertical edge of the combination box and display unit of FIG. 2, showing large slits of the perforated lines traversing the vertical edge.

Referring to FIG. 8, in one embodiment, when the unit 100 is folded, the front wall 230, side walls 214, and back wall 220 together form four vertical edges 236 of the folded box 200. When the unit 100 is die-cut, the vertical edges 236 may have larger perforations or slits 600 that will allow the tear strip 300 to disengage at these vertical edges 236 more easily.

The foregoing description is provided to enable any person skilled in the relevant art to practice the various embodiments described herein. Various modifications to these embodiments will be readily apparent to those skilled in the relevant art, and generic principles defined herein can be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

I claim:

1. A combination box and display unit comprising:

two side walls, each having a top portion and a bottom portion;

a front wall having a top portion and a bottom portion;

a back wall having a top portion and a bottom portion;

a top;

a bottom;

four vertical edges defined by the front wall, the two side walls, and the back wall;

a tear strip comprising two parallel perforated lines extending horizontally through each of the front wall and the back wall, and slanting upwardly and rearwardly through each of the two side walls;

a slot defined by an interior surface of the back wall and located below a top margin of the back wall; and a header card having a bottom portion for insertion into the slot from above, wherein the header card is visible above displayed product contained within an opened unit; and a blister tray coupled to an inside surface of the bottom, the blister tray having a plurality of indentations shaped for holding and vertically displaying product so as to project and be visible above the front wall of the opened unit;

wherein the tear strip is disengaged from each of the front wall, the two side walls, and the back wall in order to separate the top portions of the front wall, the two side walls, and the back wall from the bottom portions of the front wall, the two side walls, and the back wall; and wherein the perforated lines comprise large slits that traverse each of the four vertical edges.

2. The combination box and display unit of claim 1 wherein a majority of a front surface of the displayed product is visible above the front wall of the opened unit.

* * * * *